US006446737B1

(12) United States Patent
Fontana et al.

(10) Patent No.: US 6,446,737 B1
(45) Date of Patent: Sep. 10, 2002

(54) APPARATUS AND METHOD FOR ROTATING A PORTION OF A DRILL STRING

(75) Inventors: Peter Fontana, Houston; Marcus Oesterberg, Kingwood, both of TX (US)

(73) Assignee: Deep Vision LLC, Houston, TX (US)

( * ) Notice: Subject to any disclaimer, the term of this patent is extended or adjusted under 35 U.S.C. 154(b) by 0 days.

(21) Appl. No.: 09/660,822

(22) Filed: Sep. 13, 2000

Related U.S. Application Data

(60) Provisional application No. 60/153,717, filed on Sep. 14, 1999.

(51) Int. Cl.[7] ..... E21B 7/06
(52) U.S. Cl. ..... 175/61; 175/62; 175/107
(58) Field of Search ..... 175/61, 62, 92, 175/107, 162, 203

(56) References Cited

U.S. PATENT DOCUMENTS

| | | | | |
|---|---|---|---|---|
| 3,747,701 A | * | 7/1973 | Atkins et al. | 175/323 |
| 5,485,889 A | | 1/1996 | Gray | 175/61 |
| 6,082,457 A | * | 7/2000 | Best et al. | 175/106 |
| 6,269,892 B1 | * | 8/2001 | Boulton et al. | 175/61 |

FOREIGN PATENT DOCUMENTS

| | | |
|---|---|---|
| EP | 0 287 155 A2 | 10/1988 |
| WO | WO 96/19635 | 6/1996 |
| WO | WO 97/16622 | 5/1997 |

* cited by examiner

*Primary Examiner*—William Neuder
(74) *Attorney, Agent, or Firm*—Madan, Mossman & Sriram, P.C.

(57) ABSTRACT

The present invention provides an apparatus and method for partially rotating a drill string. The drill string of the present invention comprises upper and lower sections wherein the lower section rotates relative to the upper section of the drill string from the surface at the injector head. The upper and lower sections of the drill string can comprise coiled tubing, jointed tubing or a combination of coiled and jointed tubing. The lower section of the drill string comprises a bottom hole assembly (BHA), which comprises a drill bit and downhole drilling motor. A rotational device is positioned within the drill string in order to rotate the lower section. Upon activation of the rotational device, the lower section of the drill string will be exposed to a continuous rotation. By partially rotating the lower section of the drill string, static friction forces are overcome, the probability of differential sticking of the drill string is reduced and the cuttings produced during drilling are prevented from settling on the bottom (low side) of the wellbore, thereby maintaining a clean wellbore by dragging the cuttings back into the main fluid path.

19 Claims, 5 Drawing Sheets

APPARATUS AND METHOD FOR ROTATING A PORTION OF A DRILL STRING

CROSS-REFERENCE TO RELATED APPLICATION

This application takes priority from U.S. Patent Application Serial No. 60/153,717, filed Sep. 14, 1999.

BACKGROUND OF THE INVENTION

1. Field of the Invention

This invention relates generally to oilfield well operations and more particularly to an apparatus and method for rotating a portion of a drill sting in a subterranean wellbore.

2. Background of the Invention

In drilling oil and gas wells for the exploration of hydrocarbons, it is sometimes necessary to deviate the well off vertical and in a particular direction. A large proportion of the current drilling activity involves directional drilling, i.e., drilling deviated and horizontal boreholes, to increase the hydrocarbon production and/or to withdraw additional hydrocarbons from the earth's formations. Modern directional drilling systems generally employ a drill string having a bottom hole assembly (BHA) and a drill bit at the end thereof that is rotated by a drill motor and/or the drill string.

In vertical or near vertical drilling, cuttings produced while drilling are efficiently carried away from the wellbore by the upward velocity of the drilling fluid (commonly known as the "mud" or "drilling mud"). However, where there is more deviation in the well, the force of gravity results in the cuttings settling along the bottom side of the wellbore (sometimes referred to as the "low side"). As the cuttings settle, a "bed" of solids can form, which can significantly increase the drag forces on the drill string.

Slide-type drill string, or in particular, coiled tubing, involves a pulsating advancement of the drill string in an attempt to constantly overcome the static friction of the drill string on the formation. Drill strings which include jointed pipe as the drill pipe are rotated from the surface to change the static friction to a dynamic friction.

Current coiled tubing drilling applications, involving non-rotating drill strings, are limited by the friction created by the formation of solids in the bottom of the wellbore and the string compressible load capability in achieving the necessary depths of extended reach wellbores or highly deviated wellbores. As a result of the non-rotational setup of coiled tubing applications, the drill string is exposed to enormous amounts of axial frictional forces while sliding the drill string into and out of the wellbore. The horizontal inclinations and curvature in the wellbore increase the likelihood that a non-rotating drill string will become lodged or "stuck" in the wellbore, thereby preventing further insertion or extraction of the drill sting.

Drill strings may also become lodged in a wellbore as a result of differential sticking. Differential sticking occurs when the drill string remains at rest against the wellbore wall for a sufficient amount of time to allow filter mud to build up around the drill string. The portion of the drill string that is in contact with the mud is sealed from the hydrostatic pressure of the mud column. The pressure difference between the mud column and the formation pressure of the adjoining formation acts on the area of the drill string in contact with the mud to hold the drill string against the wall of the wellbore. This frictional engagement between the drill string and the mud inhibits or prevents axial and rotational movement of the drill string. However, the kinetic force of a rotating drill string can minimize or deter differential sticking.

Even when a jointed pipe is used as the drill pipe, rotation of the drill pipe from the surface can damage drill pipe around short radius curves and can also damage the borehole at such locations. Continuously rotating the drill string, especially along horizontal or highly deviated sections of the wellbore, can significantly reduce drag, improve hole cleaning, i.e. move cuttings through the borehole and also facilitate tripping of the drill string from the borehole.

U.S. Pat. No. 5,738,178 provides (i) coiled-tubing drill strings wherein the bottom hole assembly can be rotated without rotating the coiled tubing; and (ii) drill pipe drilling systems wherein the drill pipe above the bottom hole assembly can be rotated independent of the bottom hole assembly. However, to drill extended reach horizontal wellbores with coiled tubing drill strings, it is advantageous to rotate at least a portion of the tubing in the horizontal section with and/or without rotating the bottom hole assembly. To drill the wellbore with drill pipe drill strings, it is also advantageous to rotate at least a portion of the drill pipe in the horizontal section without necessarily rotating the remaining drill pipe from the surface.

The present invention provides apparatus and method for rotating a portion of the drill string in the wellbore. By rotating a portion of the drill string, the kinetic force prevents cuttings produced during drilling from settling in the wellbore, thereby significantly reducing the static friction between the rotating portion of the drill string and its surrounding elements and reducing the probability of differential sticking and thus allowing drilling of deeper wellbores by such a drill string compared to a non-rotating drill string. Such a system also facilitates tripping of the drill string from the wellbore.

SUMMARY OF THE INVENTION

The present invention provides apparatus and method for rotating a portion of a drill string in the wellbore. The drill string of the present invention comprises upper and lower sections wherein the lower section rotates relative to the upper section of the drill string which extends to the surface. The upper and lower sections of the drill string can comprise coiled tubing, jointed tubing or a combination of coiled and jointed tubing. The lower section of the drill string comprises at least a portion of a bottom hole assembly (BHA), which includes a drill bit and downhole drilling motor. A rotational device is positioned within the drill string in order to rotate the lower section. Upon activation of the rotational device, the lower section of the drill string will be exposed to a continuous rotation. By rotating the lower section of the drill string in the wellbore, static friction forces exhibited by the lower portion are overcome. This reduces the probability of differential sticking of the drill string in the wellbore and can prevent settling of the cuttings on the bottom (low side) of the wellbore, which allows the cuttings to move more freely with the drilling fluid.

An alternative embodiment of the present invention comprises at least one rotational device positioned between the upper and lower sections of the drill string wherein the rotational device allows for passage of wireline and/or fluid.

Another embodiment of the present invention includes at least two spaced apart rotational devices, each such device adapted to independently move a portion of the drill string downhole of the rotational device.

Examples of the more important features of the invention thus have been summarized rather broadly in order that detailed description thereof that follows may better be understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

The present invention provides an apparatus and method for rotating a portion of a drill string in any deviation from vertical to horizontal. During drilling of deviated and horizontal wellbores, drill cuttings tend to gravitationally settle and form solids on the bottom (low side) of the wellbore. Drag due to static friction in non-rotating drill strings can be several times greater than the drag when at least a portion of the drill string is continuously rotated. This is particularly problematic when drilling is performed with coiled tubing. Drill strings utilizing drill pipe (jointed tubulars) can be rotated from the surface but require great energy and may not be suitable for short radius and/or extended reach horizontal wellbores.

Figure 1:
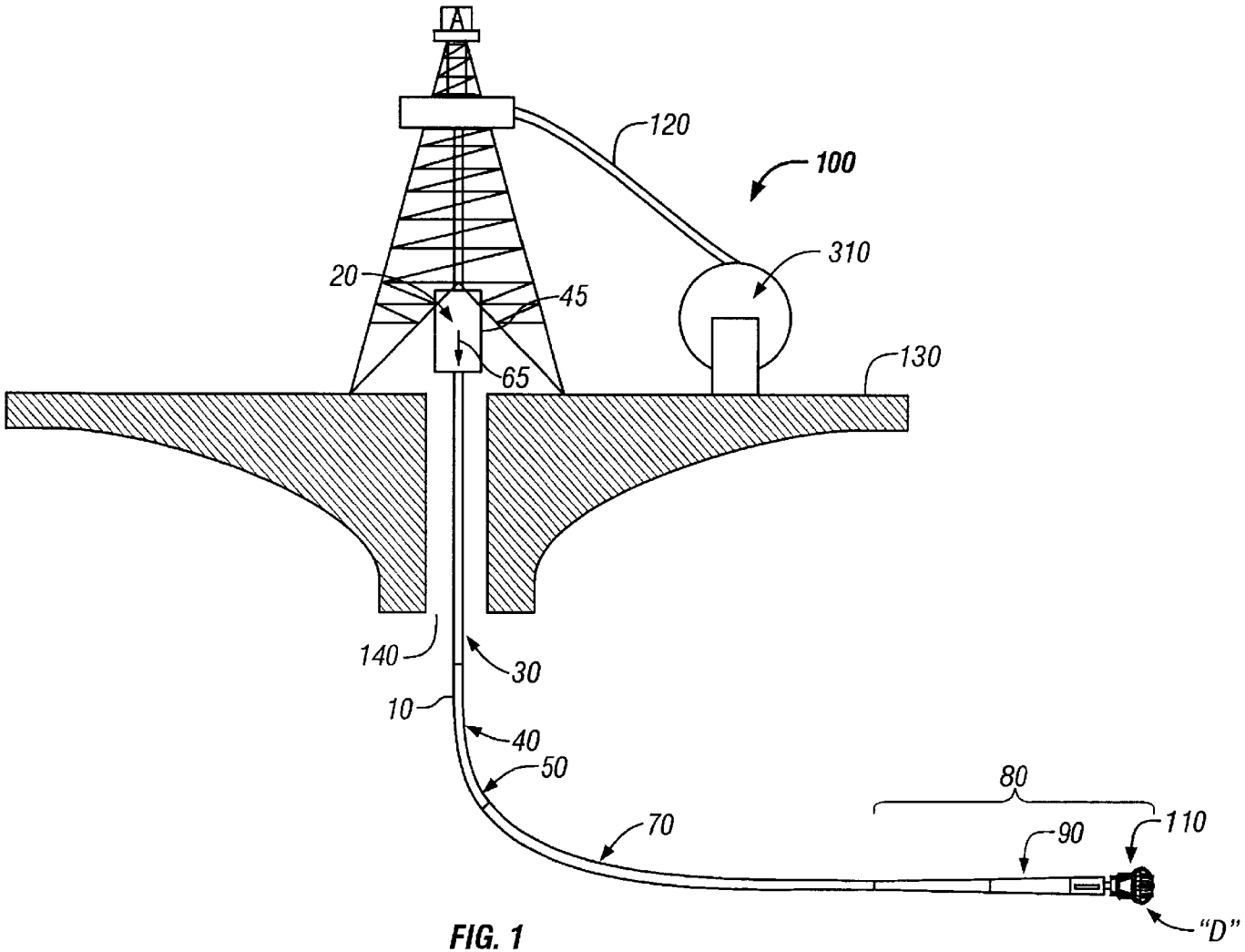
FIG. 1 illustrates a schematic diagram of a partially rotatable drilling string according to the preferred embodiment.

FIG. 1 illustrates an exemplary drilling system 100 wherein a supply of ductile tubing 120, capable of being spooled upon a tubing reel 10, is positioned on a surface workstation 130 (such as a rig or an offshore vessel or an offshore platform) for insertion into or extraction from a wellbore 140. An injector head unit 20, also located on the surface workstation 130, is utilized for inserting and retrieving the tubing 120 relative to the wellbore 140. It is contemplated that relatively rigid jointed pipe or tubing may also be used in the present invention. In such drill strings, the drill pipe is inserted or retrieved by apparatus well known in the art and the drill string can be rotated by a rotary table at the workstation 130.

In the present invention, a drill string 30 extends from a location on the surface workstation 130 to a certain depth "D" in the wellbore 140. The drill string 30 contains a bottom hole assembly (BHA) 80 located at the lowermost end of the drill string. The bottom hole assembly 80 includes a drill bit 110 for drilling the wellbore 140 and a drilling motor 90. A drilling fluid 65 from a surface mud system (not shown) is pumped under pressure down the drill string 30. The drilling fluid 65 operates the drilling motor 90 within the bottom hole assembly 80, which in turn rotates the drill bit 110. The drill bit 110 disintegrates the formation (rock) into cuttings. The drilling fluid 65 along with the cuttings leaving the drill bit 110 travels uphole in the annulus between the drill string 30 and the wellbore 140. However, in deviated and horizontal wellbores cuttings tend to settle along the bottom of the wellbore 140, which can cause the drill string 30 to become lodged. This is especially prevalent when the drill string in the horizontal section is not rotating due to the static friction between the drill string and the wellbore. The force of the drilling fluid alone may not be sufficient to move the drill cuttings through the low side of the annulus. Therefore, it is desirable to create a kinetic force at least within the deviated sections of the wellbore 140 in order to prevent the cuttings from settling or to reintroduce the cuttings into the main fluid path.

Figure 2A:
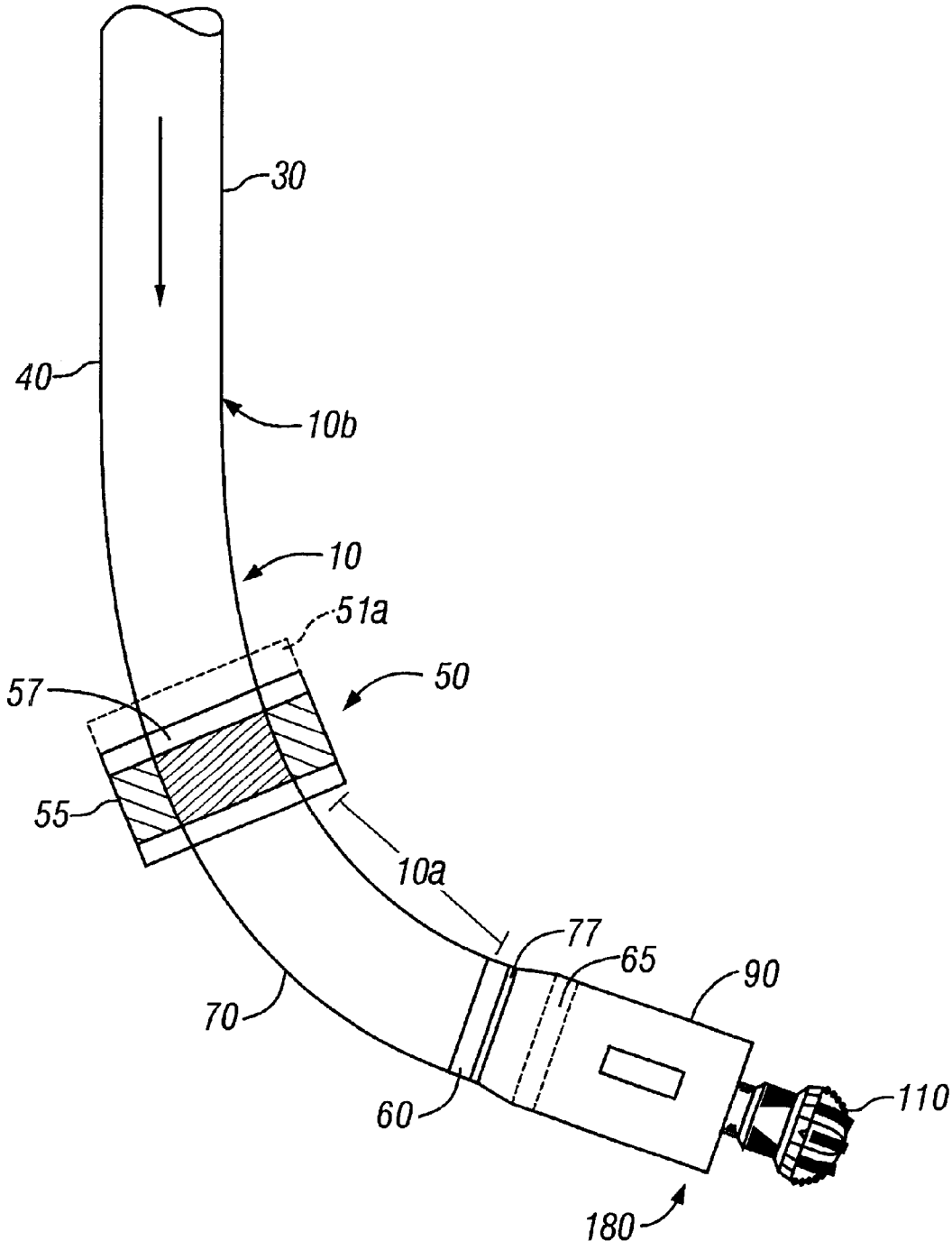
FIG. 2A illustrates drilling of a wellbore along an exemplary trajectory with a drill string made according to one embodiment of the present invention.
Figure 2B:
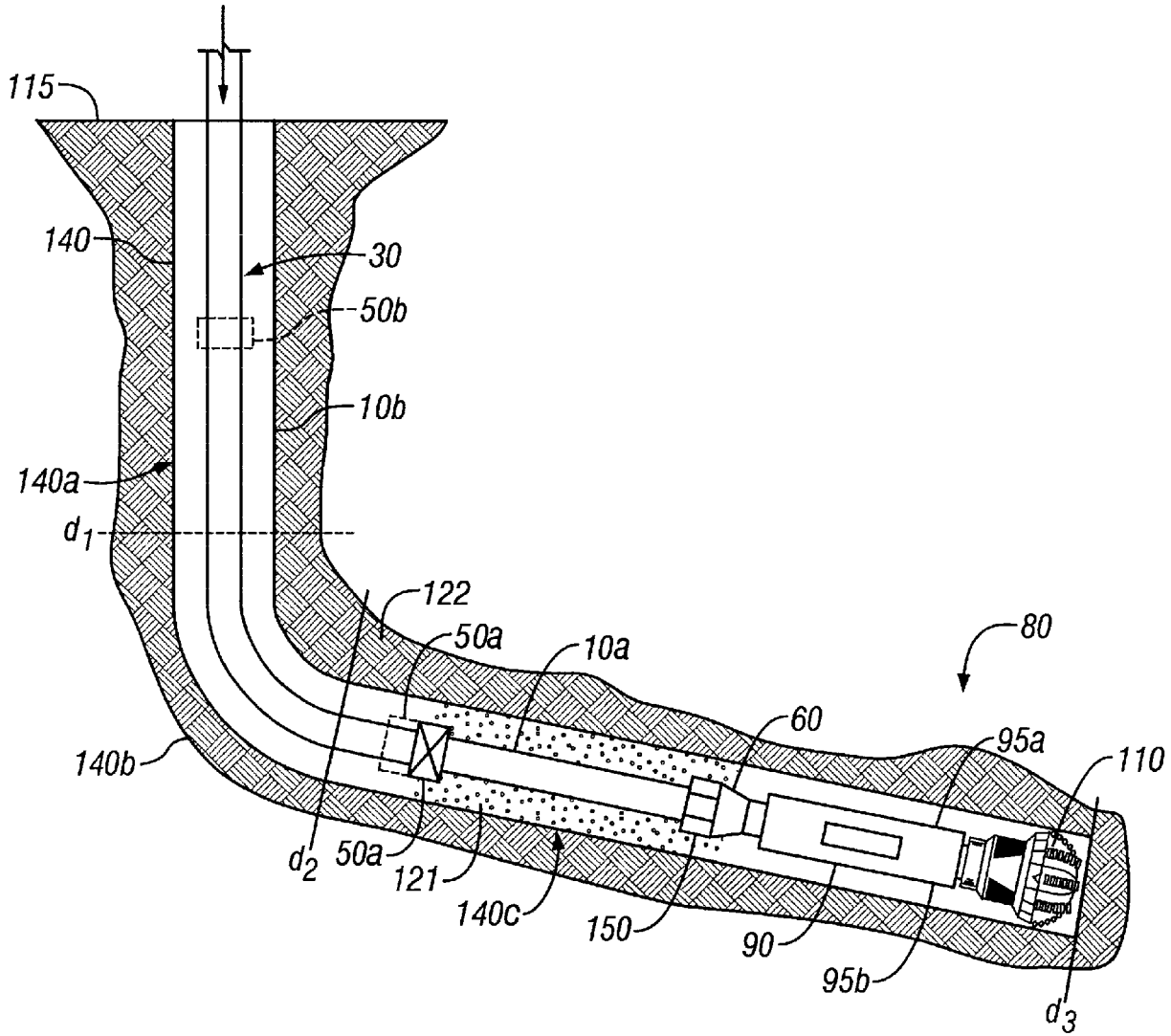
FIG. 2 illustrates a detailed diagram of the partially rotatable drilling string according to the preferred embodiment.

Referring to FIG. 2, a kinetic force is generated downhole with the use of a rotational device 50, preferably a motor, which is placed along the drill string 30, a selected distance above the bottom hole assembly 80. The rotational device 50, comprising an engagement device 55 and a power unit 57 coupled to the engagement device 55, provides rotary motion to the drill string 30. The rotational device may be operated from a remote location. The power unit 57 may comprise an electric motor, pneumatic motor, a mud motor or turbine driven by the fluid supplied to the drill string 30 during drilling.

The drill string 30 comprises a plurality of sections defined by placement of at least one rotational device 50 on the drill string 30. The upper section 40 comprises the section of the drill string 30 above or uphole of the rotational device 50 and the lower section 70 comprises the section of the drill string 30 below or downhole of the rotational device 50. The lower section 70 may include the bottom hole assembly 80 and a certain length 10*a* of the tubing 10. The length of the section 10*a* is selected depending upon the intended horizontal reach of the wellbore. This section may be from a few hundred feet to more than a thousand feet in length. The length of the section 10*a* is selected so that it's rotation is sufficient to reduce the static friction to allow proper hole cleaning and insertion of the drill string 30 into the wellbore 140 during drilling. The section 10*a* is preferably relatively rigid and may be a jointed pipe.

The upper section 40 may be a coiled tubing on a rigid tubing. When a coiled tubing is used as the upper section 40, it is fixedly attached to the upper end of the rotational device 50. When a rigid pipe is used, it may be fixedly attached via a selective engagement device 51*a* so that in one mode the upper section 40 and the lower section 70 can be engaged with each other to rotate together and in a second mode they can be rotationally disengaged so that the lower section 70 may be rotated independent of the upper section 40. Any suitable device may be used as the engagement device 51*a* for the purpose of this invention. For example, the present invention may utilize any swivel and clutch type mechanism or it may utilize an adaptation of the engagement device shown in U.S. Pat. No. 5,738,178, the entire disclosure of which patent is incorporated herein by reference.

In an alternative embodiment, a rotational device 60 may rotate the bottom hole assembly at joint 77 between the tubing and the bottom hole assembly 80. The rotational device 60 may rotate the lower string segment 70 relative to the upper string segment 40 at a relatively slow rate of speed to facilitate advancement of the drill string into the wellbore The bottom hole assembly 80 can be in excess of 100 feet and is usually significantly larger (in outer dimensions) than the tubing 10 and thus can be a source of inducing a substantial amount of the static friction. Rotating the bottom hole assembly in certain applications may be sufficient to drill extended reach wellbores.

Alternatively, more than one independently operable rotational devices may be utilized in the drill string 30. For example, one rotational device 60 to rotate the bottom hole assembly 80 and the second rotational device 50 to rotate section 10*a* of the tubing 10. The rotational devices may rotate the section 10*a* only or section 10*a* along with the bottom hole assembly 80. The rotational devices 50 and 60 are preferably independently operable by a control circuit 65 in the bottom hole assembly 80 and/or by a control circuit or unit 45 (FIG. 1) at the surface. If the upper section 40 is made from a rigid tubing, the entire drill string may be rotated to drill a portion of the wellbore.

Drilling of an extended reach horizontal wellbore, according to one method of the present invention, is described in reference to FIG. 2*a* below, which illustrates an exemplary wellbore 120 having a particular profile or trajectory that includes an initial vertical section 120*a* extending from a surface location 115 to a first depth $d_1$ followed by a relatively short radius section 120*b* having a curvature defined by radius "R" to a second depth $d_2$, which is followed by a straight inclined or horizontal section 120*c* to a depth $d_3$.

The wellbore 120 is shown being drilled by a particular embodiment of a drill string 30 made according to one embodiment of the present invention. For convenience, the elements of the drill string 30 of FIG. 2*a* that are common with the drill string of FIG. 2 are denoted by common numerals. The drill string 30 includes a rotational device 50*a* between an upper section 10*b,* which preferably is a coiled tubing, and a lower rigid pipe section 10*b.* A bottom hole assembly 80 is attached to the lower end of the bottom section 10*b* via a rotational device 60. The bottom hole assembly preferably includes a mud motor 90 for rotating the drill bit 110. Independently operable force application members 95*b* apply force on the wellbore wall to maintain the desired drilling direction. The bottom hole assembly 90 may include other directional drilling devices which aid the drill string 30 in drilling deviated holes and maintain the drill bit along a particular direction.

To drill the initial vertical section 120*a,* the drill string lower section 10*a* may be rotated. When a coiled tubing is used as the upper section it remains non-rotating. If a rigid drill pipe is used as the upper section 10*b,* both the upper and lower sections may be rotated to drill the section 120*a*. If the radius R is too short, such section may be drilled by only rotating the bottom hole assembly 80 by the rotational device 50*b* or by not rotating any portion of the drill string 30, except the drill bit 110 by the drilling motor 90.

The initial portion of the horizontal or inclined section 120*c* is drilled to a depth as the curved hole so that the lower section 10*a* lies in the horizontal section 120*c*. Further drilling preferably is performed by rotating the drill bit 110 by the mud motor 90 and by continuously rotating at least the lower section 10*a* of the drill string by the rotational device 50*a*. The bottom hole assembly 90 may also be rotated, if desired, by the rotational device 60. As noted above, the drill string of 30 allows independent selective rotation (i) of the bottom hole assembly below the device 60, (ii) of the lower drill string section 10*a* below the rotational device 50*a;* and (iii) of the upper section 10*b* from the surface, if a rigid tubing is used as the upper section. Additional rotational devices such as 50*b* may be incorporated at suitable locations in the drill string 30. The device 60 may also be utilized for directional control of the drill bit, as described in U.S. Pat. No. 5,738,170.

Thus, the present invention allows drilling of a wellbore wherein at least a portion of the drill string above the bottom hole assembly can be continuously rotated. The rotational speed can be controlled from the surface control unit 45 or by utilizing a telemetry system in conjunction with the power unit 57 (FIG. 2). The continuous rotation of the drill section 10*a* maintains dynamic friction of such section, thereby reducing drag, which allows easy insertion of the drill string 30 into the wellbore 140 for continued drilling. This also facilitates the movement of the drill cuttings 121 through the annulus 122. To retrieve the drill string from the wellbore 140, the lower section 10*a* can be continuously rotated while the injector head 20 or another suitable system pulls out the drill string 30 out from the wellbore.

Drill bit sometimes can get lodged or stuck into wellbore bottom. In such situations, rotating the drill string section 10*a* can facilitate the removal of the drill bit 110. In cases when a stuck drill bit cannot easily be dislodged, the drill string of the present invention provides a breakaway device 150 at a suitable location in the drill string 30. The drill string 30 can be disconnected at such device 150, which allows the removal of the drill string above the device 150 from the wellbore. Such removal is relatively easy since at least a portion of the drill string remains in continuous rotation. The device 150 can be installed in the bottom hole assembly 80 above the drill bit 110. In this manner at least a portion of the bottom hole assembly can be recovered, which is usually the most expensive part of the drill string 30.

The above-described staged drilling, i.e. drilling different sections in different modes, can provide more effective and efficient drilling compared to drill strings which do not allow rotation of at least a portion of the drill string above the bottom hole assembly. The location of the rotatable devices 50*a* and 50*b* can be changed whenever the drill string is tripped out of the wellbore, which occurs several times during drilling of extended reach wellbores.

Figure 3:
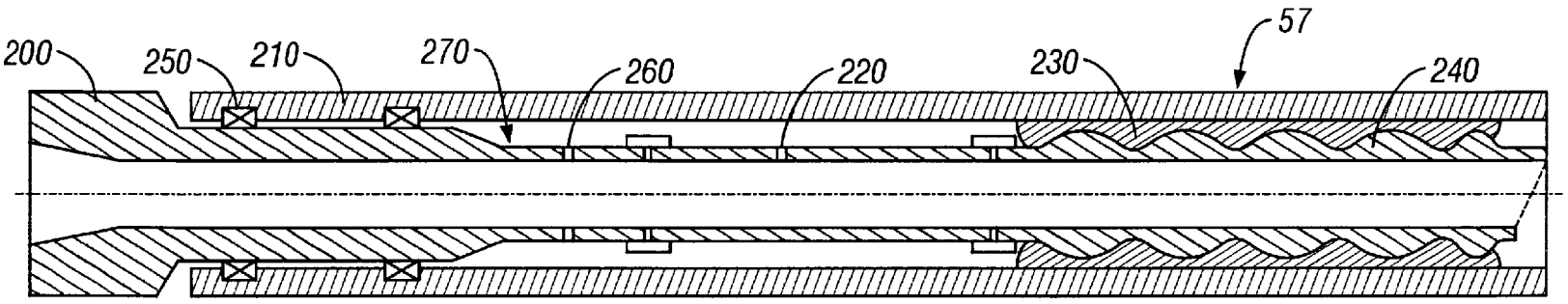
FIG. 3 illustrates a cross-sectional view of a portion of the lower section of the drill string.

FIG. 3 illustrates a cross-sectional view of a portion of the lower section 70 of the drill string 30 which comprises an inner drive train 260. The inner drive train 260 comprising a drive sub 200, a flex shaft 220 and the power unit 57, is connected to the upper section 40 of the drill string 30 (FIG. 1). Adjacent the inner drive train 260 is the outer housing 210, which rotates in response to the fluid flow through the power unit 57 when the power unit comprises either a mud motor or turbine.

Figure 4:
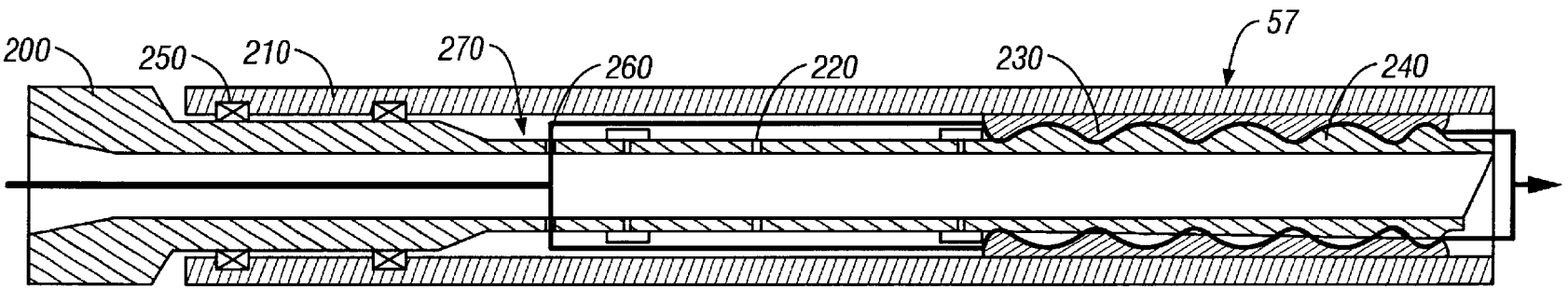
FIG. 4 illustrates a cross-sectional view of a portion of the lower section of the drill string and the fluid path from the surface workstation to the bottom hole assembly.

FIG. 4 illustrates the fluid path which originates from the surface into the drive sub 200, through the flow ports 200 and through the chamber of the power unit 57, which comprises a stator housing 230 and a rotor 240. Utilization of this fluid path allows for rotation of the outer housing 210 of the lower section 70 of the drill string 30. The fluid path continues through the lower section 70 of the drill string 30 to the bottom hole assembly 80.

Figure 5:
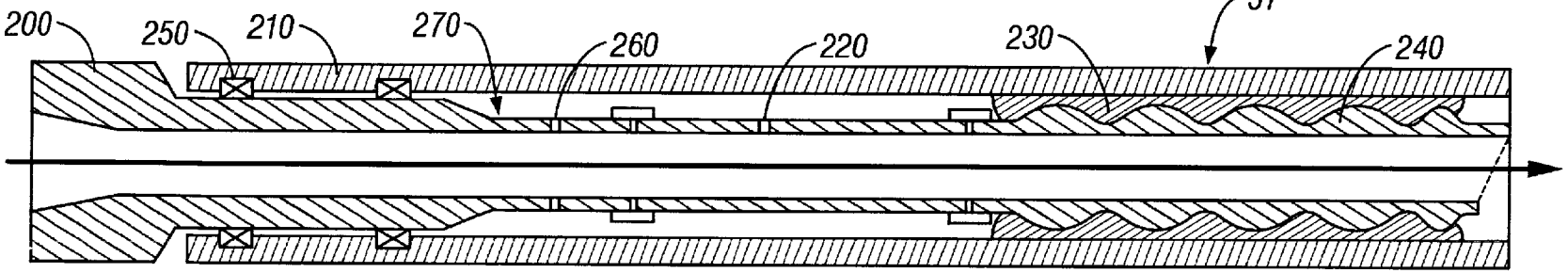
FIG. 5 illustrates a cross-sectional view of a portion of the lower section of the drill string and an alternative fluid path from the surface workstation to the bottom hole assembly.

FIG. 5 illustrates an alternative fluid path. This fluid path occurs when the flow ports 200 are closed, thereby allowing fluid to flow directly to the bottom hole assembly 80 without passing though the chamber of the power unit 57. Therefore, when the fluid ports 200 are closed, there is no rotation of the lower section of the drill string.

Figure 6:
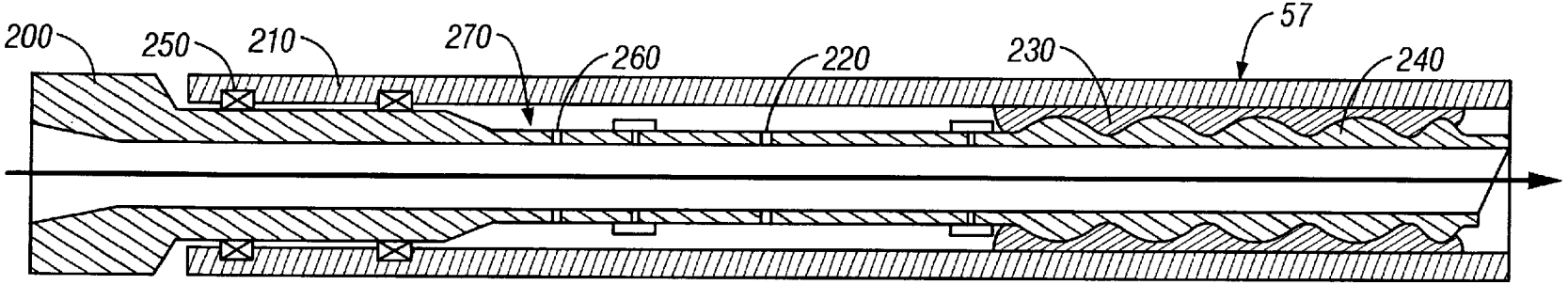
FIG. 6 illustrates a cross-sectional view of a portion of the lower section of the drill string which allows passage of wireline and fluid.

FIG. 6 illustrates a path within the lower section of the drill string wherein at least one rotational device along the drill string allows passage of wireline and fluid while providing rotary motion to the drill string.

The foregoing description is directed to particular embodiments of the present invention for the purpose of illustration and explanation. It will be apparent, however, to one skilled in the art that many modifications and changes to the embodiment set forth above are possible without departing from the spirit of the invention.

What is claimed:

1. A drill string for use in drilling an oilfield wellbore, comprising;

a. a tubing extending from a surface location to a certain depth in said wellbore;

b. a drilling assembly having a drill bit at a bottom end thereof for drilling said oilfield wellbore, said drilling assembly coupled to said tubing; and c. a rotational device in the drill string at a predetermined distance uphole of said drill bit, said rotational device rotating a section of said drill string downhole of said rotational device ("lower section") relative to a drill string section ("upper section") uphole of said rotational device to reduce static friction in said lower section during drilling of said oilfield wellbore, wherein the rotational device comprises;

(i) an engagement device which allows rotation of said lower section relative to said upper section; and (ii) a rotational power unit operatively coupled to said engagement device, said power unit engaging with said engagement device to rotate said lower section.

2. The drill string according to claim 1, wherein said tubing is one of (i) a rigid jointed tubing and; (ii) a combination of a flexible coiled tubing and a rigid jointed tubing.

3. The drill string according to claim 1, wherein said lower section comprises a rigid tubing and the upper section is one of (i) a rigid tubing; or (ii) a flexible coiled tubing.

4. The drill string according to claim 1, wherein said rotational power unit generates rotary motion by one of: (i) mud motor driven by fluid supplied to said drill string during drilling of said oilfield wellbore; (ii) a turbine driven by drilling fluid supplied under pressure to said drill string during drilling of said oilfield wellbore; (iii) an electric motor; and (iv) a pneumatic motor.

5. The drill string according to claim 1, wherein said rotational device is remotely-activated from a surface location.

6. The drill string according to claim 1 further comprising a second rotational device spaced apart from said first rotational device, said second rotational device rotating a section of drill string downhole of said second rotational device.

7. The drill string according to claim 6, wherein each said first and second rotational device is independently operable to rotate section of said drill string downhole of each said rotational device.

8. The drill string according to claim 6, wherein each said first and second rotational device is remotely-activated from said surface location.

9. The drill string according to claim 6, wherein said second rotational device rotates the drilling assembly.

10. A method of drilling a wellbore utilizing a drill string having a bottom hole assembly including a drill bit at end thereof, the method comprising:

(a) providing a first rotational device in said drill string adjacent said bottom hole assembly;

(b) providing a second rotational device in said drill string spaced above said bottom hole assembly, with a segment of said drill string below said second rotational device constituting a lower string segment and the segment above said second rotational device constituting an upper string segment;

(c) activating said first rotational device to rotate said drill bit at a first and relatively high rate of speed for drilling said wellbore; and (d) activating said second rotational device to rotate said lower string segment relative to said upper string segment at a second and relatively slow rate of speed to facilitate the advancement of said drill string into said wellbore.

11. The method of claim 10, wherein said first and second rotational devices are hydraulic motors and said activating comprises providing fluid under pressure to said motors via said drill string.

12. The method of claim 10, wherein said drilling string comprises coiled tubing and said upper string segment slides within said wellbore.

13. A method of drilling a wellbore with a drill string having a drill bit at an end thereof, an upper tubing section and a lower tubing section, said lower tubing section being rotatable relative to the upper tubing section, the method comprising:

(a) drilling a first vertical section of the wellbore with the drill string;

(b) drilling a second curved section of the wellbore with the drill string; and (c) drilling a third highly deviated or substantially horizontal section of the wellbore with the drill string while rotating the lower section of the drill string within the third section of the wellbore to reduce friction of the drill string.

14. The method of claim 13, further comprising (i) providing the upper section of the drill string that is rotatable in an engaged position with said lower section; and (ii) drilling the first vertical section by one of (a) while rotating the lower section of the drill string or (b) rotating both the lower section and upper section of the drill string.

15. The method of claim 13, wherein drilling the second curved section comprises drilling such curved section without rotating the lower section of the drill string.

16. The method of claim 13 further comprising retrieving the drill string from the wellbore while rotating the lower section.

17. A method of reducing the friction between a drill string and a wellbore, the method comprising;

a. coupling a rotational device at a predetermined location in a drill string in a wellbore, said rotational device having an engagement device and a rotational power unit; and b. activating the rotational device to rotate a section of the drill string downhole of said rotational device "lower section" relative to a drill string section uphole of said rotational device "upper section" to reduce static friction in said lower section during drilling of said wellbore.

18. The method of claim 17, wherein the rotational device is one of (i) mud motor driven by fluid supplied to said drill string during drilling of said oilfield wellbore; (ii) a turbine driven by drilling fluid supplied under pressure to said drill string during drilling of said oilfield wellbore; (iii) an electric motor; and (iv) a pneumatic motor.

19. The method of claim 17, further comprising remotely activating the rotational device from a surface location.

* * * * *